US006514042B2

(12) United States Patent
Kvasnak et al.

(10) Patent No.: US 6,514,042 B2
(45) Date of Patent: Feb. 4, 2003

(54) METHOD AND APPARATUS FOR COOLING A WALL WITHIN A GAS TURBINE ENGINE

(75) Inventors: William S. Kvasnak, Guilford, CT (US); Ronald S. LaFleur, Potsdam, NY (US); Friedrich O. Soechting, Tequesta, FL (US); Christopher R. Joe, Glastonbury, CT (US); Joe Moroso, Greenville, SC (US); Douglas A. Hayes, Port St. Lucie, FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/965,036

(22) Filed: Sep. 26, 2001

(65) Prior Publication Data

US 2002/0021966 A1 Feb. 21, 2002

Related U.S. Application Data

(63) Continuation of application No. 09/412,950, filed on Oct. 5, 1999, now Pat. No. 6,402,470.

(51) Int. Cl.[7] ..... F01D 5/16
(52) U.S. Cl. ..... 416/97 R; 415/115
(58) Field of Search ..... 415/115, 116; 416/96 R, 96 A, 97 R, 97 A

(56) References Cited

U.S. PATENT DOCUMENTS

| | | | |
|---|---|---|---|
| 3,819,295 | A | 6/1974 | Hauser et al. |
| 3,902,820 | A | 9/1975 | Amos |
| 3,973,874 | A | 8/1976 | Corsmeier et al. |
| 4,021,139 | A | 5/1977 | Franklin |
| 4,042,162 | A | 8/1977 | Meginnis et al. |
| 4,080,095 | A | 3/1978 | Stahl |
| 4,185,369 | A | 1/1980 | Darrow et al. |
| 4,203,706 | A | 5/1980 | Hess |
| 4,221,539 | A | 9/1980 | Corrigan |
| 4,353,679 | A | 10/1982 | Hauser |
| 4,487,550 | A | 12/1984 | Horvath et al. |
| 4,529,358 | A | 7/1985 | Papell |
| 4,542,867 | A | 9/1985 | Memmen |
| 4,601,638 | A | 7/1986 | Hill et al. |
| 4,669,957 | A | 6/1987 | Phillips et al. |
| 4,684,322 | A | 8/1987 | Clifford et al. |
| 4,768,700 | A | 9/1988 | Chen |
| 4,776,172 | A | 10/1988 | Havercroft |
| 5,340,274 | A | 8/1994 | Cunha |
| 5,344,283 | A | 9/1994 | Magowan et al. |
| 5,370,499 | A | 12/1994 | Lee |
| 5,403,159 | A | 4/1995 | Green et al. |
| 5,413,458 | A | 5/1995 | Calderbank |
| 5,484,258 | A | 1/1996 | Isburgh et al. |
| 5,695,320 | A | 12/1997 | Kercher |
| 5,771,577 | A | 6/1998 | Gupta et al. |
| 5,813,836 | A | 9/1998 | Staarweather |
| 5,820,337 | A | 10/1998 | Jackson et al. |
| 5,822,853 | A | 10/1998 | Ritter et al. |

OTHER PUBLICATIONS

"Advanced Airfoil Fabrication", James R. Dobbs and Jeffrey A. Graves, General Electric Company, Corporate Research and Development, Schenectady, NY 12301.
Sergey Meshkov, Rybinsk Motor–Building Design Bureau, Rybinsk, Yaroslavi Region Russia, pp. 523–529.

*Primary Examiner*—Christopher Verdier

(57) ABSTRACT

A cooling circuit is provided disposed between a first wall portion and a second wall portion of a wall for use in a gas turbine engine, one or more inlet apertures, and one or more exit apertures. The inlet aperture(s) provides a cooling airflow path into the cooling circuit and the exit aperture(s) provides a cooling airflow path out of the cooling circuit. The cooling circuit includes a plurality of first pedestals extending between the first wall portion and the second wall portion. The first pedestals are arranged in one or more rows.

7 Claims, 4 Drawing Sheets

METHOD AND APPARATUS FOR COOLING A WALL WITHIN A GAS TURBINE ENGINE

This application is a continuation of U.S. patent application Ser. No. 09/412,950 filed on Oct. 5, 1999, now U.S. Pat. No. 6,402,470, which application is hereby incorporated by reference.

The invention claimed herein was made under U.S. Government contract F33615-95-C-2503 and the Government has rights herein.

BACKGROUND OF THE INVENTION

1. Technical Field

This invention relates to gas turbine engines in general, and to cooling passages disposed within a wall inside of a gas turbine engine.

2. Background Information

A typical gas turbine engine includes a fan, compressor, combustor, and turbine disposed along a common longitudinal axis. The fan and compressor sections work the air drawn into the engine, increasing the pressure and temperature of the air. Fuel is added to the worked air and the mixture is burned within the combustor. The combustion products and any unburned air, hereinafter collectively referred to as core gas, subsequently powers the turbine and exits the engine producing thrust. The turbine comprises a plurality of stages each having a rotor assembly and a stationary vane assembly. The core gas passing through the turbine causes the turbine rotors to rotate, thereby enabling the rotors to do work elsewhere in the engine. The stationary vane assemblies located forward and/or aft of the rotor assemblies guide the core gas flow entering and/or exiting the rotor assemblies. Liners, which include blade outer air seals, maintain the core gas within the core gas path that extends through the engine.

The extremely high temperature of the core gas flow passing through the combustor, turbine, and nozzle necessitates cooling in those sections. Combustor and turbine components are cooled by air bled off a compressor stage at a temperature lower and a pressure greater than that of the local core gas. The nozzle (and augmentor in some applications) is sometimes cooled using air bled off of the fan rather than off of a compressor stage. There is a trade-off using compressor (or fan) worked air for cooling purposes. On the one hand, the lower temperature of the bled compressor air provides beneficial cooling that increases the durability of the engine. On the other hand, air bled off of the compressor does not do as much work as it might otherwise within the core gas path and consequently decreases the efficiency of the engine. This is particularly true when excessive bled air is used for cooling purposes because of ineffective cooling.

One cause of ineffective cooling can be found in poor film characteristics in those applications utilizing a cooling air film to cool a wall. In many cases, it is desirable to establish film cooling along a wall surface. A film of cooling air traveling along the surface of the wall increases the uniformity of the cooling and insulates the wall from the passing hot core gas. A person of skill in the art will recognize, however, that film cooling is difficult to establish and maintain in the turbulent environment of a gas turbine. In most cases, air for film cooling is bled out of cooling apertures extending through the wall. The term "bled" reflects the small difference in pressure motivating the cooling air out of the internal cavity of the airfoil. One of the problems associated with using apertures to establish a cooling air film is the film's sensitivity to pressure difference across the apertures. Too great a pressure difference across an aperture will cause the air to jet out into the passing core gas rather than aid in the formation of a film of cooling air. Too small a pressure difference will result in negligible cooling airflow through the aperture, or worse, an in-flow of hot core gas. Both cases adversely affect film cooling effectiveness. Another problem associated with using apertures to establish film cooling is that cooling air is dispensed from discrete points, rather than along a continuous line. The gaps between the apertures, and areas immediately downstream of those gaps, are exposed to less cooling air than are the apertures and the spaces immediately downstream of the apertures, and are therefore more susceptible to thermal degradation.

Another cause of ineffective cooling stems from the inability of some current designs to get cooling air where it is needed. Referring to FIG.6, in a conventional airfoil the trailing edge cooling apertures typically extend between an upstream first cavity and the pressure side exterior surface. The trailing edge cooling apertures generally include a meter portion and diffuser downstream of the meter portion. The diffuser has a surface profile that includes an upstream edge and a downstream edge. Under typical operating conditions: the static pressure ($P_1$) at the upstream edge is greater than the static pressure ($P_2$) at the exit of the meter portion; the static pressure ($P_3$) at the entrance to the meter portion is equal to or less than the static pressure ($P_2$) at the exit of the meter portion; and the static pressure ($P_3$) at the entrance to the meter portion is equal to that within the cavity ($P_4$). The relative static pressure values may be expressed as follows: $P_1>P_2$, $P_2 \geqq P_3$, and $P_3=P_4$. Note that these pressures reflect the static pressure of the flow, which may not equal the total pressure at any particular position. Total pressure is the sum of the dynamic pressure and the static pressure of the flow at any particular position. The dynamic pressure reflects the kinetic energy of the flow by considering the flow's velocity at that particular position.

In those applications where the above pressure profile exists, cooling apertures (shown in phantom for explanation purposes) cannot be disposed between the first cavity and the outer surface of the airfoil because of the pressure difference across the apertures. Specifically, the static pressure $P_1$ at the outer surface, which is greater than the static pressure $P_4$ in the first cavity (i.e., $P_1>P_4$), would cause undesirable hot gas inflow through the apertures. Cooling apertures upstream of the trailing edge must tap into a second cavity upstream of the first cavity that contains cooling air having a static pressure ($P_5$) greater than the static pressure at the trailing edge ($P_1$; $P_5>P_1$). For practical reasons, cooling apertures tapped into the second cavity are spaced a relatively long distance from the trailing edge cooling apertures. Cooling air exiting from those apertures is often ineffective at cooling the region upstream of the trailing edge cooling apertures located on the pressure side.

Hence, what is needed is a cooling apparatus and method that uses less cooling air and provides greater cooling effectiveness than conventional cooling schemes, one that helps create a uniform film of cooling air, and one that permits versatility in the positioning of cooling apertures.

DISCLOSURE OF THE INVENTION

It is, therefore, an object of the present invention to provide an apparatus and method for cooling a wall that provides convective cooling within the wall.

It is another object of the present invention to provide an apparatus and a method for initiating film cooling along a wall.

According to the present invention, a cooling circuit is provided disposed between a first wall portion and a second wall portion that includes one or more inlet apertures and one or more exit apertures. The inlet aperture(s) provides a cooling airflow path into the cooling circuit and the exit aperture(s) provides a cooling airflow path out of the cooling circuit. The cooling circuit includes a plurality of first pedestals extending between the first wall portion and the second wall portion. The first pedestals are arranged in one or more rows. According to one aspect of the present invention, adjacent first pedestals in any particular row are separated from one another by an intra-row distance, and adjacent first pedestals in adjacent rows are separated by an inter-row distance. The intra-row distance is greater than inter-row distance.

According to another aspect of the present invention, the passages formed between adjacent first pedestals in adjacent rows include a diffuser to diffuse cooling air flowing through the passage and a pair of throats to accelerate cooling air flow.

An advantage of the present cooling circuit is that it promotes uniformity in the film cooling layer aft of the cooling circuit. One aspect of the present cooling circuit that promotes film cooling development (which in turn leads to film layer uniformity) is the spacing of the pedestals. It is our experience that the inter-row and the intra-row pedestal spacing described herein promotes lateral dispersion of cooling air within the cooling circuit better than any cooling arrangement of which we are aware. The increased lateral dispersion, in turn, produces a more uniform film cooling aft of the circuit.

Another aspect of the present cooling circuit that promotes uniformity in the film cooling layer aft of the cooling circuit is the compartmentalization provided by the cooling circuit. Each cooling circuit is an independent compartment designed to internally provide a plurality of incremental pressure drops between the inlet aperture(s) and the exit apertures. The incremental pressure drops increase the likelihood there will always be a positive flow of cooling air into the cooling circuit. The positive flow of cooling air through the circuit, in turn, positively affects the cooling circuit's ability to create film cooling aft of the circuit.

The present invention's ability to use a low pressure drop across the inlet aperture(s) provides another substantial benefit. A person of ordinary skill in the art will recognize that conventional casting cores used to create conventional cooling passages are notoriously difficult to handle and use because of their frailty. The frailty of a conventional casting core is particularly acute in the portion used to form the inlet aperture(s) because of the small diameter of the inlet aperture(s) (the small diameter is used to create a considerable pressure drop). The cooling circuit of the present invention allows for an inlet aperture diameter appreciably greater than that conventionally used without sacrificing cooling performance. We have found that the more robust casting core possible with the present invention may increase casting yields as much as 50%.

Some embodiments of the present invention include specialized exit apertures that promote uniformity in the film cooling layer aft of the cooling circuit. The aft most rows of pedestals include a plurality of mating second and third pedestals alternately disposed across the width of the cooling circuit. Cooling air flow encountering the second and third pedestals must travel first through an initial passage section between the heads of adjacent second and third pedestals, subsequently through a straight passage section, and finally into a diffuser passage section. The initial passage sections have a substantially constant cross-section that meters the cooling air as it enters the exit apertures. The initial passage sections follow the contour of the pedestal heads for a distance to minimize flow separation aft of the head of each second pedestal. Flow separation behind a blunt body pedestal can create undesirable cooling characteristics. The straight passage section has substantially the same cross-section as the initial section. Fluid flowing through the straight section, therefore, does not accelerate but rather settles prior to entering the diffuser passage section with no appreciable pressure losses. Any entrance effects that may exist within the flow exiting the initial passage section are substantially diminished within the straight passage section prior to reaching the diffuser passage section. The straight passage section, therefore, performs a different function than the metering portion of a conventional diffused cooling aperture. The metering portion of a conventional diffused cooling hole is used to decrease the pressure of a fluid passing through the metering portion. The decrease in pressure across the metering portion is accompanied by an acceleration (i.e., a positive change in velocity) of the fluid passing therethrough. One of the consequences of the change in fluid velocity is the appearance of entrance effects within the boundary layer velocity profile. In our experience, fluid characterized by entrance effects that enters a diffuser does not diffuse as uniformly as does more settled flow. It is our further experience that settled flow entering the diffuser portion diffuses more readily, consequently promoting greater uniformity in the film cooling layer aft of the cooling circuit.

The embodiment of the present cooling circuit that includes a diffuser section in the passage between adjacent first pedestals provides an additional advantage in the form of enhanced convective cooling. Each passage between first pedestals includes a diffuser disposed between a pair of throats. Flow passing through the upstream throat will decelerate in the diffuser and subsequently accelerate passing through the downstream throat. Positioning the diffuser between the throats in this manner creates at least two regions of transient fluid velocity within each passage. The regions of transient fluid velocity are characterized by boundary layer entrance effects that have an average convective heat transfer coefficient higher than would be associated with fully developed fluid flow in a straight passage under similar circumstances. The higher heat transfer coefficient positively influences the heat transfer rate individually within the passage and collectively within the cooling circuit.

Another advantage of the present invention cooling circuit is the versatility it provides in terms of cooling aperture placement. As stated above, one of the hottest areas on an airfoil is immediately upstream of the trailing edge cooling apertures on the pressure side surface of the airfoil. The compartmentalized nature of the present cooling circuits, and the incremental pressure drops created therein permit the inclusion of additional cooling apertures within the cooling circuit. In the application of a cooling circuit disposed along the trailing edge of an airfoil, the additional apertures immediately upstream of the trailing edge exit enables the delivery of cooling air to that hottest point on the airfoil.

These and other objects, features and advantages of the present invention will become apparent in light of the detailed description of the best mode embodiment thereof, as illustrated in the accompanying drawings.

DETAILED DESCRIPTION OF THE INVENTION

Figure 1:
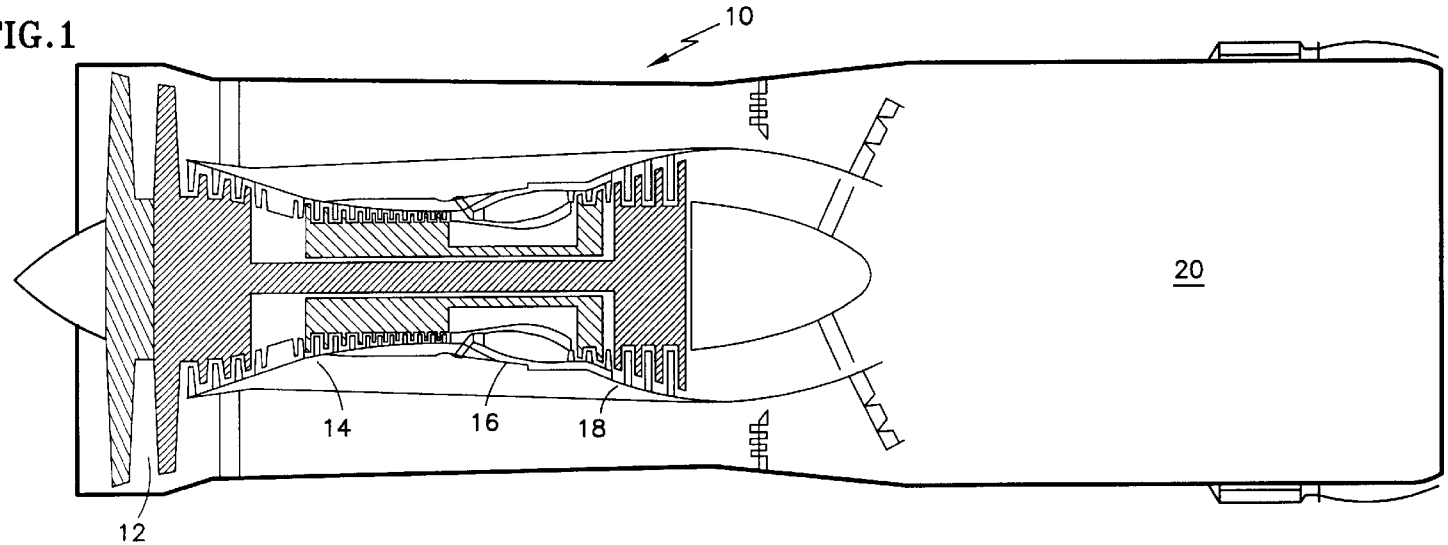
FIG. 1 is a diagrammatic view of a gas turbine engine.
Figure 2:
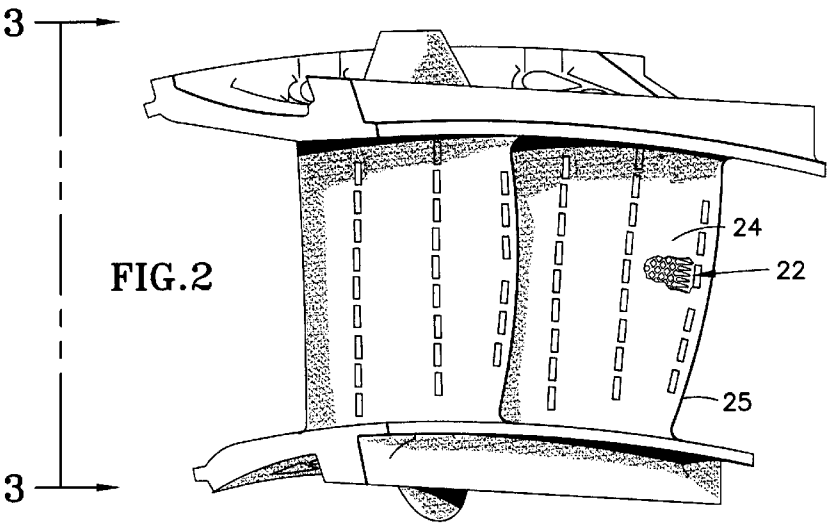
FIG. 2 is a diagrammatic view of a gas turbine engine stator vane that includes a plurality of the present invention cooling circuits, of which the aft ends can be seen extending out of the vane wall.

Referring to FIGS. 1 and 2, a gas turbine engine 10 includes a fan 12, a compressor 14, a combustor 16, a turbine 18 and a nozzle 20. In and aft of the combustor 16, most components exposed to core gas are cooled because of the extreme high temperature of the core gas. The initial rotor stages and stator vane stages within the turbine 18, for example, are cooled using cooling air bled off a compressor stage 16 at a pressure higher and temperature lower than the core gas passing through the turbine 18. A plurality of cooling circuits 22 (see FIG. 2) are disposed in a wall to transfer thermal energy from the wall to the cooling air. Cooling circuits 22 can be disposed in any wall 24 that requires cooling, but in most cases the wall 24 is exposed to core gas flow on one side and cooling air on the other side. For purposes of giving a detailed example, the present invention cooling circuit 22 will be described herein as being disposed within a wall of an airfoil portion 25 of a stator vane or a rotor blade. The present invention cooling circuit 22 is not limited to those applications, however, and can be used in other walls (e.g., platforms, liners, blade seals, etc.) exposed to a high temperature environment.

Figure 3:
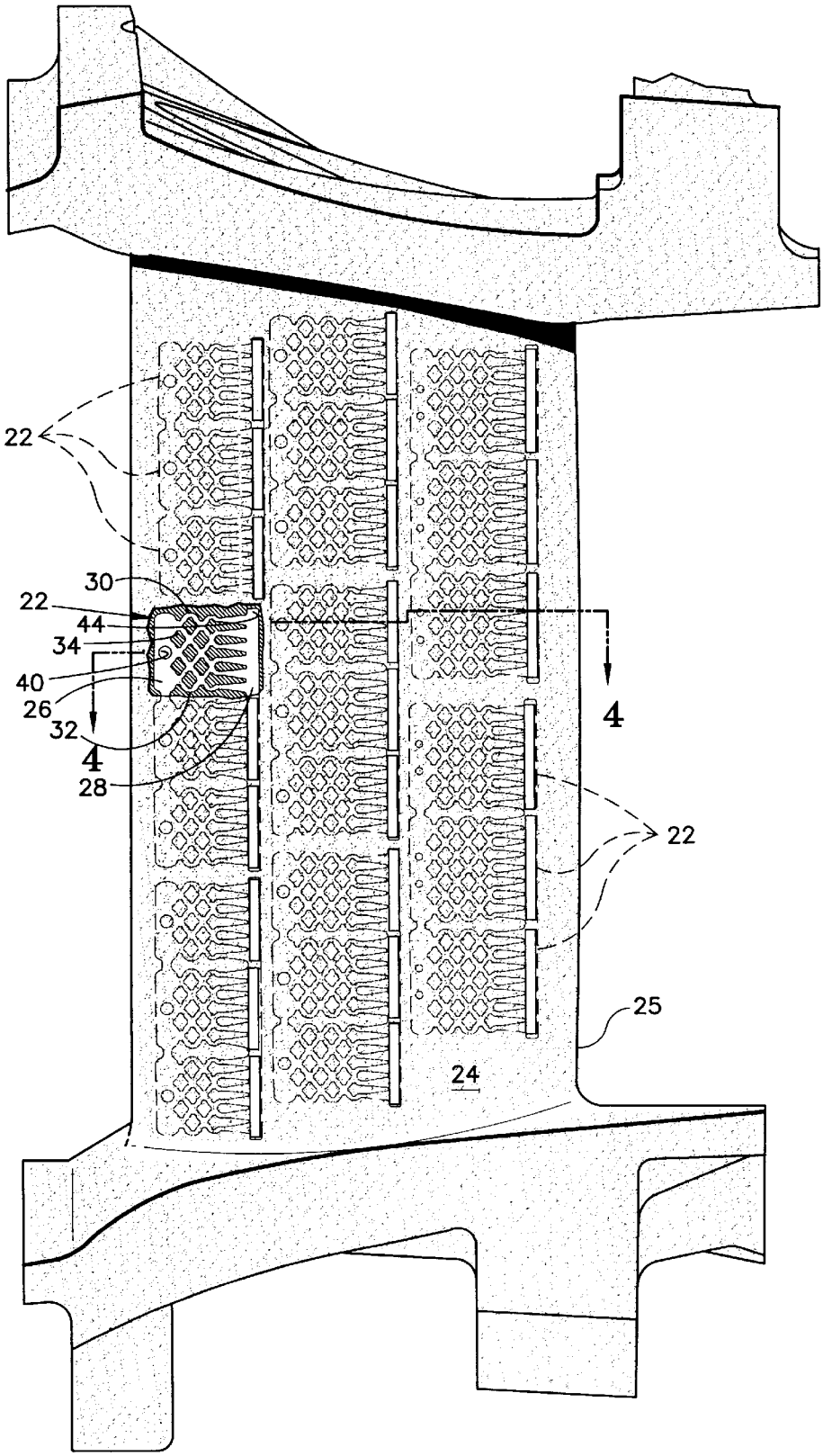
FIG. 3 is a diagrammatic view of a gas turbine engine stator vane showing the present invention cooling circuits exposed for illustration sake.
Figure 4:
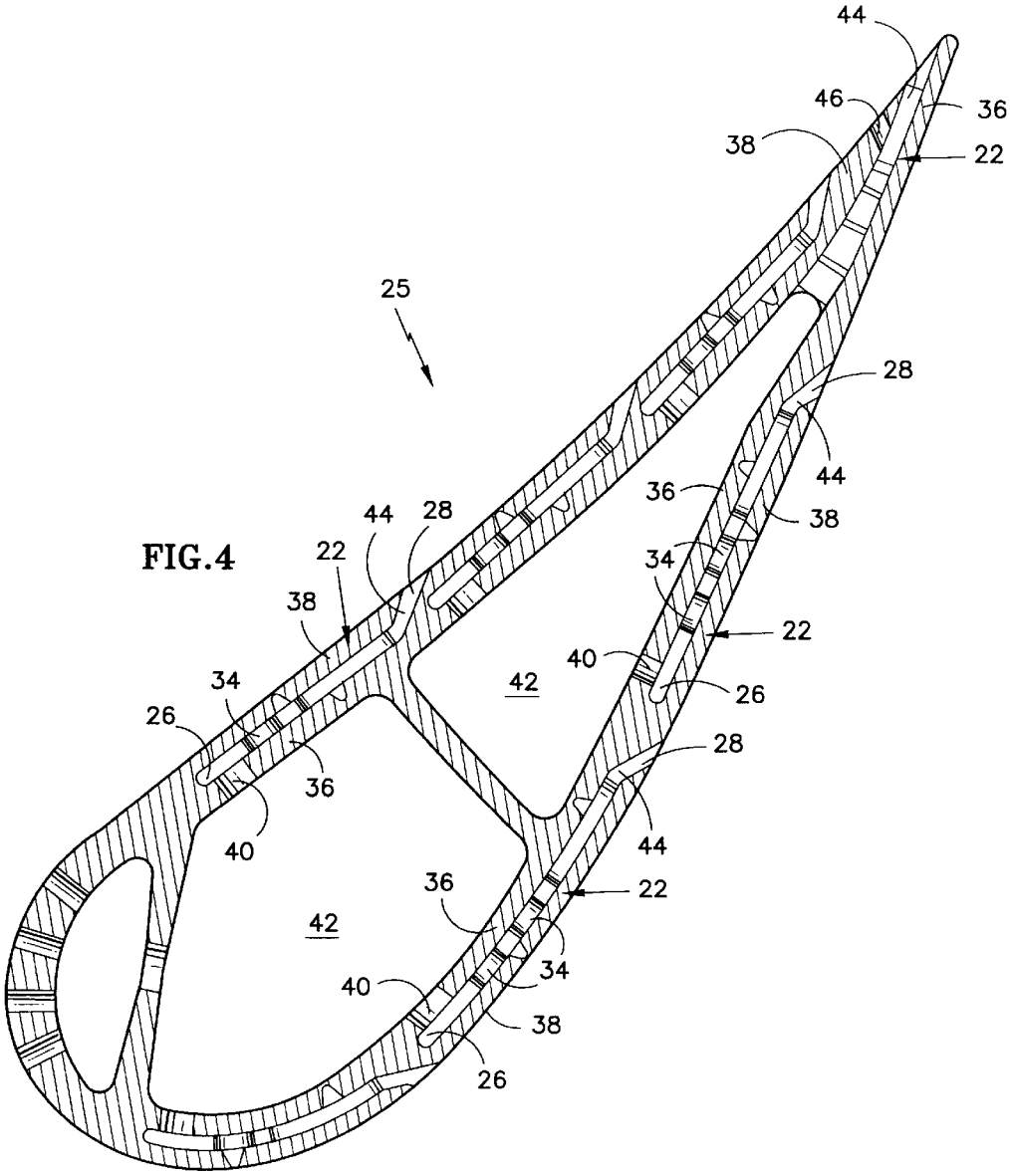
FIG. 4 is a diagrammatic is a cross-sectional view of an airfoil having a plurality of the present invention cooling circuits disposed within the wall of the airfoil.
Figure 6:
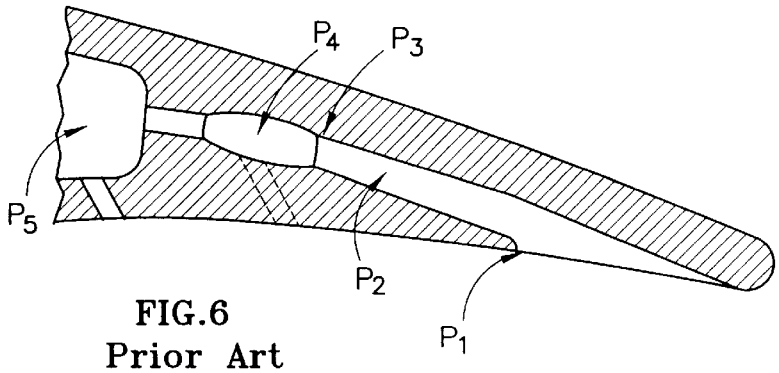
FIG.6 Prior Art
FIG. 6 is a cross-section of a portion of a prior art airfoil.
Figure 5:
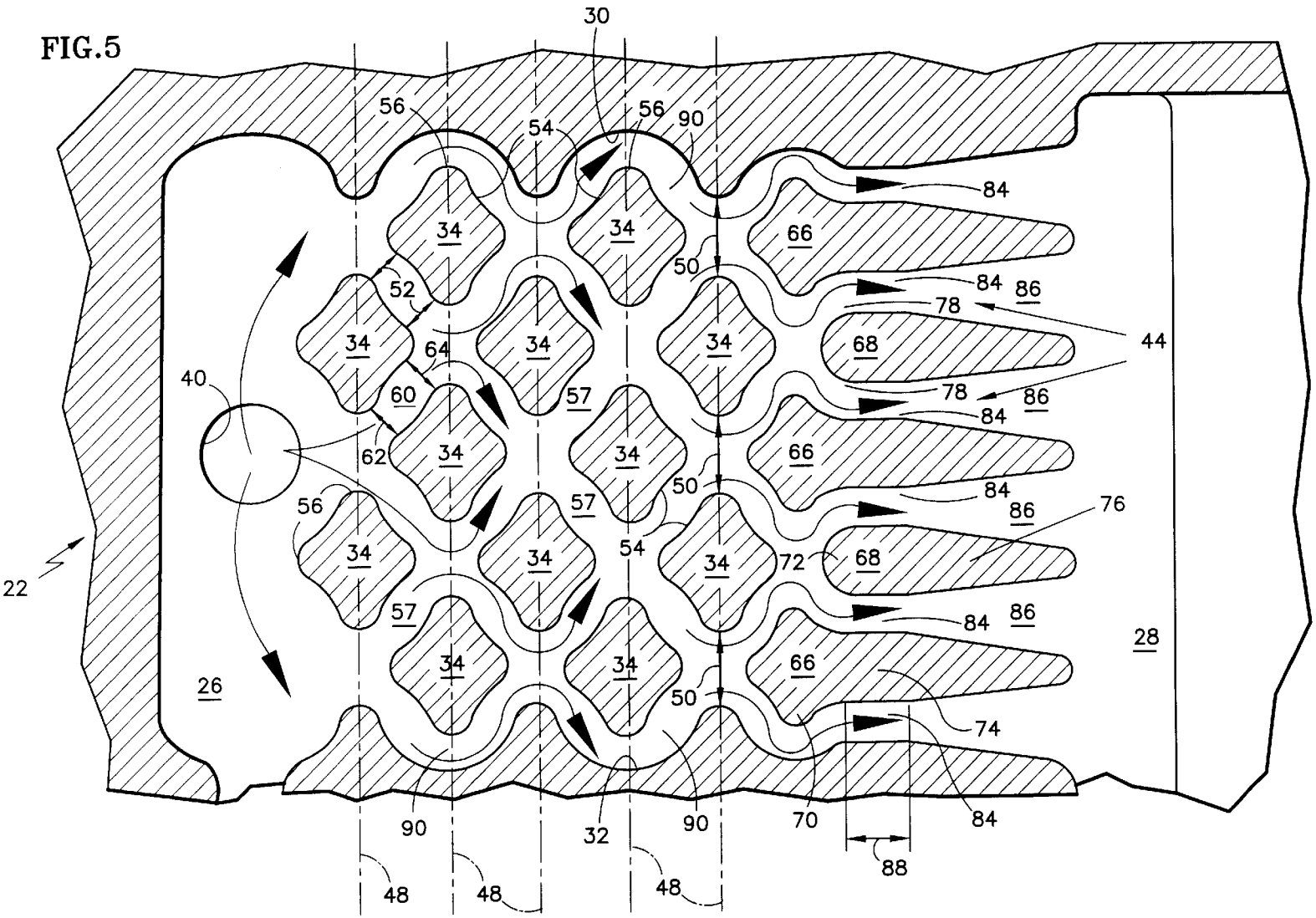
FIG. 5 is an enlarged view of one of the present invention cooling circuits.

Referring to FIGS. 3–5, the cooling circuit 22 includes a forward end 26, an aft end 28, a first side 30, a second side 32, and a plurality of first pedestals 34 that extend between a first wall portion 36 and a second wall portion 38 (see FIG. 4). The cooling circuit 22 extends lengthwise between its forward end 26 and aft end 28, and widthwise between its first side 30 and second side 32. At least one inlet aperture 40 extends between the forward end 26 of the cooling circuit 22 and the cavity 42 (see FIG. 4) of the airfoil 25, providing a cooling airflow path into the forward end 26 from the cavity 42 of the airfoil 25. A plurality of exit apertures 44 extend through the second wall portion 38, providing a cooling airflow path out of the aft end 28 of the cooling circuit 22 and into the core gas path outside the wall. In some instances additional exit-type apertures (described below as "array" apertures 46—see FIG. 4) may be disposed upstream of the exit apertures 44. The cooling circuit 22 is typically oriented forward to aft along streamlines of the core gas flow, although orientation may vary to suit the application at hand.

Referring to FIG. 5, the first pedestals 34 are spaced apart from one another in a pattern that encourages lateral dispersion of cooling air flowing through the cooling circuit 22. Specifically, the first pedestals 34 are arranged in an array that includes one or more rows 48 that extend in a substantially widthwise direction across the cooling circuit 22. The first pedestals 34 in each row 48 are offset from the first pedestals 34 in the adjacent row or rows 48. The offset is enough such that there is substantially no straight-line passage through the cooling circuit 22. The spacing of first pedestals 34 within the array can be described in terms of an intra-row distance 50 and an inter-row distance 52. The intra-row distance 50 is defined as the shortest distance between a pair of adjacent first pedestals 34 disposed within a particular row 48. The inter-row distance 52 is defined as the shortest distance between a pair of adjacent first pedestals 34 in adjacent rows 48. It is our experience that an array of first pedestals 34 having an intra-row distance 50 greater than an inter-row distance 52 provides better lateral cooling air dispersion than vice versa. An array of first pedestals 34 having an intra-row distance 50 at least one and one-half (1½) times greater than the inter-row distance 52 is preferred over an array having an intrarow distance 50 slightly greater than its inter-row distance 52. The most preferred array of first pedestals 34 has a first pedestal intra-row distance 50 that is approximately twice that of the inter-row distance 52. The number of first pedestal rows 48 and the number of first pedestals 34 in a row can be altered to suit the application at hand as will be discussed below. FIG. 3 shows a plurality of different cooling circuits 22 (e.g., different numbers of rows, number of pedestals in a row, number of inlet apertures, etc.) disposed in a stator vane wall 24 to illustrate some of the variety of cooling circuits 22 possible.

The advantageous lateral dispersion of cooling air provided by the above-described pedestal spacing is substantially independent of the shape of the first pedestals 34. Each first pedestal 34 preferably includes a cross-section defined by a plurality of concave side panels 54 that extend inwardly toward the center of that first pedestal 34, separated from one another by tips 56. The most preferred first pedestal 34 shape (shown in FIGS. 3 and 5) includes four arcuate side panels 54 that curve inwardly toward the pedestal center. The four-sided pedestal shape created by the arcuate side panels 54 creates a plurality of distinctively shaped passages 57 between adjacent first pedestals 34, each of which includes a diffuser 60 disposed between a pair of throats 62,64. The diffuser 60 is formed between the concave side panels 54 and the throats 62,64 are formed between the adjacent tips 56. Flow passing through the upstream throat 62 decelerates in the increasing area of the diffuser 60 and subsequently accelerates passing through the downstream throat 64. The preferred shape first pedestals 34 are arranged in each row 48 tip-to-tip, as is shown in FIGS. 3 and 5. For the pedestals shown, the distance between pedestal tips 56 in a particular row 48 is equal to the intra-row distance 50, and the distance between tips 56 of adjacent first pedestals 34 in adjacent rows 48 is equal to the inter-row distance 52.

The preferred exit apertures 44 are formed between a plurality of mating second pedestals 66 and third pedestals 68 alternately disposed across the width of the cooling circuit 22 at the aft end 28 of the cooling circuit 22 that extend between the wall portions 36,38. Each second pedestal 66 and third pedestal 68 has a head 70,72 attached to and upstream of a body 74,76. The shapes of the second pedestal head 70 and third pedestal head 72 are such that a passage 78 is formed between the two heads 70,72, preferably constant in cross-sectional area. That passage 78, referred to hereinafter as a metering passage section 78, meters the cooling air flow and helps minimize flow separation aft of each second pedestal head 70. Downstream of the heads 70,72, each second pedestal body 74 and each third pedestal body 76 includes a straight portion and a tapered portion. The adjacent straight portions form a substantially constant width straight passage section 84 and the adjacent tapered portions taper away from one another to form an increasing width diffuser passage section 86. The straight passage section 84 typically has a length 88 at least one-half (½_) its hydraulic diameter, but generally not greater than four (4) of its hydraulic diameters. Preferably, the length 88 of the straight passage sections 84 is at least one (1) hydraulic diameter but not greater than two (2) hydraulic diameters. In our experience, a straight passage section length 88 approximately equal to one and one-half (1½_) the hydraulic diameter is most preferred. Collectively, the passage sections (metering 78, straight 84, and diffuser 86) between adjacent second pedestals 66 and third pedestals 68 and the wall portions 36,38 form each exit aperture 44.

Referring to FIG. 4, the cooling circuit 22 may include additional cooling air apertures 46 upstream of the exit apertures 44. These cooling air apertures, hereinafter referred to as array apertures 46, extend through the second wall portion 38 to provide a cooling air passage from the first pedestal array to the outside of the wall 24. The positioning of each array aperture 46 will depend on the application. As mentioned above, airfoil trailing edge cooling is particularly problematic in many conventional airfoils immediately upstream of the trailing edge cooling apertures. If the present cooling circuits 22 are used to provide trailing edge cooling on an airfoil, one or more cooling circuits 22 could include one or more array apertures 46 as a means to provide cooling air immediately upstream of the exit apertures 44. In this manner, the array apertures 46 of the present cooling circuit 22 could help satisfy cooling requirements immediately upstream of the trailing edge cooling apertures common to conventional airfoil cooling schemes.

In some applications, the passages 90 along the widthwise edges of the cooling circuit 22 may be slightly larger in cross-section (i.e., "oversized") than the passages 57 elsewhere within the array of pedestals. The slightly oversized cross-section allows the casting core used to form the cooling circuit 22 to be more robust, consequently improving the casting yield. The slight increase in cross-section is not enough to appreciably change the flow characteristics within the cooling circuit 22.

A principal requirement that determines certain cooling circuit 22 characteristics is the effectiveness of the film of cooling air produced by that cooling circuit for a given flow of cooling air. The desired film effectiveness (and the film characteristics that produce that effectiveness) determines the pressure drop across the cooling circuit 22. The characteristics of the first pedestals 34, particularly the geometry of the passage 57 formed between pedestals 34, determine the pressure drop across any particular row 48. The number of rows 48 of first pedestals 34 is therefore determined by matching the sum of the incremental pressure drop for each row 48 to the pressure drop across the cooling circuit 22 that produces the desired film effectiveness for the given flow of cooling air. The number of first pedestals 34 in a row 48 is optimal when the lateral dispersion of the cooling air within the cooling circuit 22 is sufficient to provide uniform cooling air flow across all of the exit apertures 44 within the cooling circuit 22.

Although this invention has been shown and described with respect to the detailed embodiments thereof, it will be understood by those skilled in the art that various changes in form and detail thereof may be made without departing from the spirit and scope of the claimed invention.

What is claimed is:

1. A cooling circuit disposed between a first wall portion and a second wall portion of a wall for use in a gas turbine engine, comprising:

a plurality of first pedestals extending between said first wall portion and said second wall portion, and arranged in rows, and wherein adjacent said first pedestals in the same said row are separated from one another by an intra-row distance;

wherein said first pedestals in adjacent said rows are separated by an inter-row distance, and said intra-row distance is equal to or greater than one and one-half times said inter-row distance;

one or more inlet apertures disposed in said wall providing a cooling air flow path into said cooling circuit; and one or more exit apertures disposed in said wall providing a cooling air flow path out of said cooling circuit.

2. The cooling circuit of claim 1, wherein said intra-row distance is equal to or greater than two times said inter-row distance.

3. The cooling circuit of claim 1, further comprising one or more array apertures disposed upstream of said one or more exit apertures.

4. The cooling circuit of claim 1, wherein said first pedestals within adjacent said rows are offset from one another and passages extending through two or more of said first pedestal rows follow a serpentine path.

5. The cooling circuit of claim 4, wherein said intra-row distance is the minimum distance between said pedestals in the same said row.

6. The cooling circuit of claim 5, wherein said inter-row distance is the minimum distance between said pedestals in adjacent said rows.

7. A coolable wall having a first wall portion and a second wall portion, said wall comprising:

one or more cooling circuits disposed between said wall portions, each said cooling circuit including a plurality first pedestals extending between said wall portions, arranged in rows, and one or more exit apertures that provide a cooling air flow path out of said cooling circuit;

wherein adjacent said first pedestals in the same said row are separated from one another by an intra-row distance, and said first pedestals in adjacent said rows are separated by an inter-row distance, and said intra-row distance is equal to or greater than one and one-half times said inter-row distance; and an inlet aperture providing a cooling air flow path into said cooling circuit.

* * * * *